US009182195B2

(12) United States Patent
Hogue

(10) Patent No.: US 9,182,195 B2
(45) Date of Patent: Nov. 10, 2015

(54) ROTATING STORAGE CASE

(71) Applicant: Mark Wayne Hogue, Austin, TX (US)

(72) Inventor: Mark Wayne Hogue, Austin, TX (US)

( * ) Notice: Subject to any disclaimer, the term of this patent is extended or adjusted under 35 U.S.C. 154(b) by 354 days.

(21) Appl. No.: 13/741,381

(22) Filed: Jan. 14, 2013

(65) Prior Publication Data

US 2014/0197057 A1 Jul. 17, 2014

(51) Int. Cl.

| | |
|---|---|
| ***B65D 85/00*** | (2006.01) |
| ***F41C 33/06*** | (2006.01) |
| *B65D 25/04* | (2006.01) |

(52) U.S. Cl.

CPC ..... *F41C 33/06* (2013.01); *B65D 25/04* (2013.01)

(58) Field of Classification Search

CPC ..... B65D 25/04

USPC ..... 206/3, 315.11, 317, 523, 561; 211/53, 211/56, 58, 64, 70, 78, 115, 164, 131.1, 211/131.2; 220/523, 524; 312/117, 125, 312/135, 138.1, 305

See application file for complete search history.

(56) References Cited

U.S. PATENT DOCUMENTS

| | | | | | |
|---|---|---|---|---|---|
| 505,320 | A | | 9/1893 | Meadows | |
| 1,552,290 | A | | 9/1925 | Fowler | |
| 1,829,995 | A | * | 11/1931 | Lineberger | 312/120 |
| 2,100,280 | A | | 11/1937 | Goldberger | |
| 2,416,603 | A | | 2/1942 | Wilson | |
| 2,512,622 | A | | 6/1950 | Fish | |
| 2,562,593 | A | * | 7/1951 | Adams | 312/305 |
| 2,646,891 | A | | 7/1953 | Morgan | |
| 2,832,659 | A | * | 4/1958 | Akers | 312/266 |
| 2,857,230 | A | | 11/1958 | Scidal | |
| 3,132,652 | A | * | 5/1964 | Gazdik | 132/297 |
| 3,762,789 | A | | 10/1973 | Robertson | |
| 3,784,024 | A | | 1/1974 | Kristy | |
| 3,871,156 | A | | 3/1975 | Koenig et al. | |
| 4,099,808 | A | | 7/1978 | Oakley et al. | |
| 4,742,405 | A | | 5/1988 | Teranishi | |
| 4,890,466 | A | | 1/1990 | Cislo | |
| 5,003,925 | A | | 4/1991 | Roberts | |
| 5,021,901 | A | | 6/1991 | Mondocea et al. | |
| 5,039,180 | A | | 8/1991 | Lemons | |
| 5,425,576 | A | * | 6/1995 | Yee et al. | 312/125 |
| 5,913,557 | A | | 6/1999 | Jarock | |
| 5,921,394 | A | | 7/1999 | Shcroff | |
| 6,206,493 | B1 | * | 3/2001 | Sanchez-Levin et al. | 312/125 |
| 6,244,439 | B1 | * | 6/2001 | Dennis | 206/457 |
| 6,547,070 | B1 | | 4/2003 | Kolpin | |
| 6,570,501 | B2 | | 5/2003 | Bushnell et al. | |
| D475,196 | S | | 6/2003 | VanSkiver et al. | |
| 6,843,081 | B1 | | 1/2005 | Painter | |
| 6,920,977 | B1 | | 7/2005 | VanSkiver et al. | |
| 7,159,711 | B1 | | 1/2007 | Gardner | |
| 7,422,102 | B1 | | 9/2008 | Lam et al. | |
| 7,559,428 | B2 | | 7/2009 | Matzick | |
| 7,571,811 | B2 | * | 8/2009 | Mulaw | 206/535 |
| 2013/0180939 | A1 | * | 7/2013 | Wilder | 211/78 |

OTHER PUBLICATIONS http:www.sportsmanguide.com/net/cb/rotating-sportsmans-rack.aspx?a=556279, on Feb. 9, 2012, (four pages).

http://unclemikes.com, on Feb. 9, 2012, (two pages).

* cited by examiner

*Primary Examiner* — Luan K Bui

(74) *Attorney, Agent, or Firm* — Pierson IP, PLLC

(57) ABSTRACT

Embodiments described herein disclose a cylindrical housing with a compartment defining a section of the housing. The cylindrical housing being configured to rotate around an axle disposed at the center of the cylindrical housing. Embodiments may also include a frame disposed along a curved surface of the cylindrical housing configured to allow access to the compartment within an access portion, wherein the access portion projects the frame from a center of the curved surface towards an edge of the cylindrical housing.

15 Claims, 13 Drawing Sheets

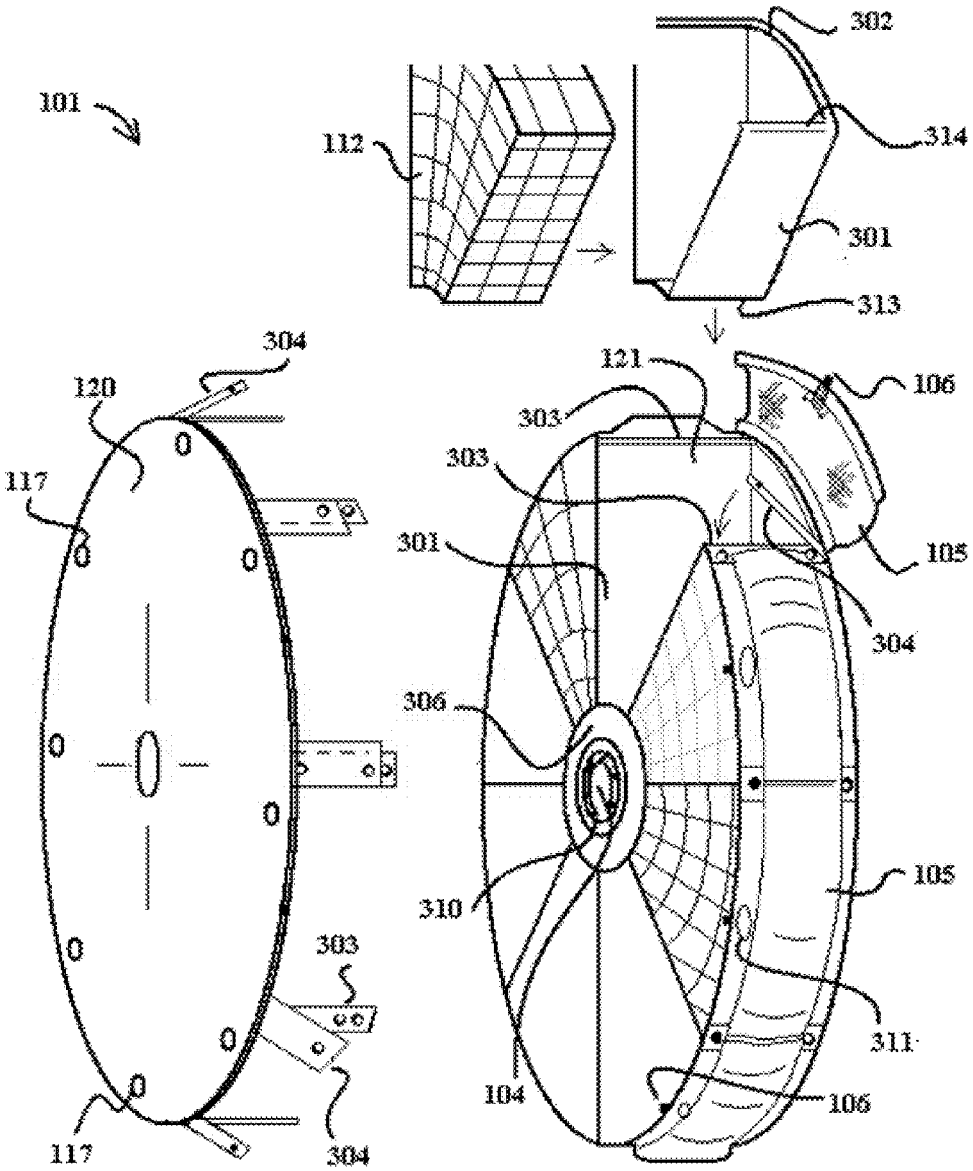
Fig 3A
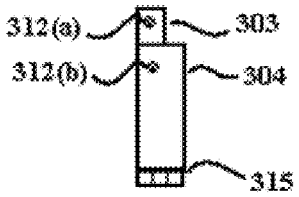
Figure 3B(1)
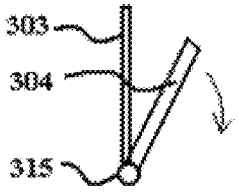
Figure 3B(2)

ROTATING STORAGE CASE

TECHNICAL FIELD

This disclosure relates generally to systems and methods for a case to house items. Specifically, this disclosure relates to a rotatable case with compartments that are independently accessible.

BACKGROUND

Conventional cases such as bags, crates, boxes, etc. are used to store and transport various items. Typically, cases include a centrally located main compartment, sometimes with secondary compartments disposed on the sides or in front of the main compartment. To access items disposed within the different compartments, a user is required to reposition himself or reposition the case to access the different compartments.

When a user visits a shooting range, he may use a range bag to carry his guns and related items. Conventional range bags, especially those that have the capacity to carry multiple handguns and associated supplies, typically are wide and include a plurality of compartments that are difficult to access in a small space such as a shooting stall. Conventionally, range bags are either soft-sided bags with items vertically stacked within the range bag or they are a hard-sided case whereby, to gain access to various items housed within the range bag, the user may be required to lay the range bag on its side and open a compartment.

Upon entering the shooting range, the user may place his range bag within a shooting stall. While a user is within the shooting stall, objects such as the range bag may be placed on the floor around the user, which may create safety hazards. The user may be constantly stepping around or positioning his feet around the range bag while operating a loaded weapon within the stall.

Further, certain shooting stalls may not have walls and the user may be required to bend over to access different compartments of the range bag disposed on the floor to switch weapons. When the user bends over, their head or other parts of their body may be positioned in close proximity to another user in an adjacent stall shooting his weapon.

Accordingly, conventional cases occupy excessive floor space and require movement of the case and items for the user to access items within various compartments of the case.

To this end, needs exist for improved cases, such as range bags, that efficiently house a plurality of items, conserve space and improve safety.

SUMMARY

Embodiments described herein disclose a case for the storage and transportation of items. The case may take up a small footprint or area of space while providing access to a plurality of different compartments. In one embodiment, the case may be configured to be used in an area where space and/or distractions may be a concern, such as shooting ranges, center consoles cars, motorcycles, bicycles, console area or control area for boats, and/or airplanes.

The case may be perpendicularly aligned to a surface or floor, without having to lay the case flat or reposition the case while extracting or placing items within the compartments. The compartments become accessible via a hinged door by rotating the case around an axle.

The case may be configured to carry and store items in a padded area, and include a base, a housing for storing items, and a handle.

The base may be configured to support the housing and include compartments that can store items such as ammunition, supplies, small tools, etc.

The housing may be a cylindrical or disk-shaped housing configured to couple with the base and rotate around an axle. The housing may have rigid or hard sidewalls and include a plurality of compartments that may be substantially triangular in shape, which form different sections corresponding to the cylindrical housing.

Each of the compartments may have a respective door. The door for each compartment may be coupled to the housing via a hinge disposed on an edge or the curved surface of the housing. Each door may have an individual lock, which may be any known locking mechanism such as a lock-and-key device, a number combination, a push-button combination, a biometric fingerprint lock, etc.

Each compartment may house a removable tray that may be extracted from the housing. The trays may include removable foam inner surface, foam pieces and/or padded layers configured to house an item. The trays may be substantially triangular in shape and correspond to the shape of the compartments. The trays and compartments may be configured to allow each item to have its own assigned compartment, custom fitted for that item, which may be accessed independently of the other compartments. In one embodiment, if an item placed within a tray is a weapon, the muzzle of the weapon may be positioned in close proximity to a center of the housing or a notch of the triangular shaped compartment and/or the tray, and the handle or grip of the weapon may extend past the curved surface of the housing. The trays may hold the plurality of foam pieces, such as cubes, that may be dynamically arranged within the tray to create a custom-fit space for the item within the tray.

To access different compartments of the housing, the housing may be rotated around an axle on a frame. The frame may be a circular, rigid frame corresponding to the curved surface of the housing. The frame may extend from the base and extend around the curved surface of the housing. The frame may include an access portion, where a door of a compartment may be opened and closed. The access portion may be configured to allow only a single door to be opened at any given time. Therefore, while the door of one compartment is opened, items disposed within other compartments may be securely housed. The access portion may be positioned at an upper portion of the frame. Due to the placement of the access portion and the vertically and/or rotationally aligned housing, items disposed within compartments may be accessible from a much higher position than conventional cases. This may create a more comfortable, natural and safer retrieval of items housed within the case. Also, due to the shape of the housing, the compartments may be vertically arranged to cover less floor space.

The frame may include a lock configured to fix the housing in place, and not allow the housing to be rotated. The lock may be positioned in a location on the housing where none of the doors is aligned with the access portion, thereby preventing all of the doors from opening.

In one embodiment, the housing may include a gear or any other device to create resistance against the axle to limit, reduce or not allow the housing to independently rotate without additional force. In one embodiment, it may be desired or required for a small amount of pressure or force, (manually, mechanically or electronically), to be applied to the housing to overcome the resistance to rotate the housing about the axle.

In one embodiment, the housing may be secured to a physical structure via a lockable bracket.

In one embodiment, the frame may include a handle and/or wheels to assist in transportation of the case.

In one embodiment, the case may include extendable legs that are configured to extend perpendicularly to the housing to stabilize the case.

In one embodiment, the case may be secured by a frame which is at least part of another physical structure, such as within furniture, the interior of a structure, the interior, trunk or other position of a vehicle, boat, airplane, bicycle, motorcycle or other mode of transportation or mobility. In a specific embodiment, the physical structure may be a center console of a vehicle between the passengers and drivers seats, on the side of a motorcycle, or the controls of a watercraft vehicle.

In one embodiment, the case may be electronically wired and communicatively coupled to a remote or button(s). The remote or button(s) may be utilized to access different compartments within the housing. For example, by a user pressing input on the remote or the button(s) different compartments may be positioned to be opened.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

FIG. 3A depicts an embodiment of a perspective view of an example embodiment of housing.

FIG. 3B(1) depicts an embodiment of a front view of a retention bar in relation to a spacing bar.

FIG. 3B(2) depicts an embodiment of a side view of a retention bar in relation to a spacing bar.

DETAILED DESCRIPTION

Figure 1A:
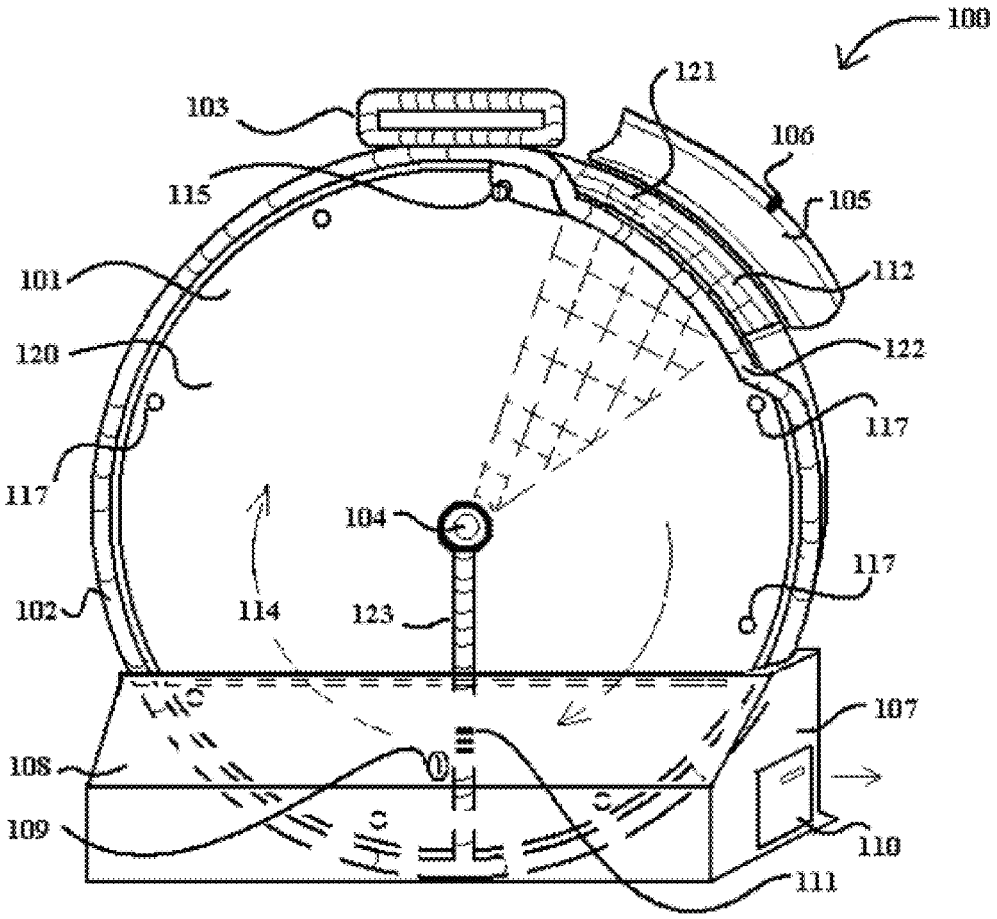
FIG. 1A depicts an embodiment of a case.

The invention and the various features and advantageous details thereof are explained more fully with reference to the nonlimiting embodiments that are illustrated in the accompanying drawings and detailed in the following description.

Descriptions of well-known starting materials, processing techniques, components and equipment are omitted so as not to unnecessarily obscure the invention in detail.

It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

The term case disclosed herein may refer to any kind of storage case configured to hold, store, house, transport, etc. various types of items, and the term case may be used interchangeably with the terms range bag, container, housing, and the like. Items may be any type of consumer goods, which may be a weapon such as a firearm. Although the terms, firearm, handgun, pistol, weapon are used herein, the terms may be used interchangeably with any type of item and/or consumer good.

The term axle assembly as used herein may refer to the combination of the combination of an axle, gears, bearings, teeth, washers, connectors, etc.

Before discussing specific embodiments disclosed herein, a general discussion may prove helpful. Conventional cases are bulky and require items to be positioned within the case in a lengthwise fashion (end-to-end or side-by-side), or in different compartments. The compartments in conventional cases may have different opening mechanisms positioned at different locations and require a user to reorient himself or the case to access the different compartments.

Embodiments as disclosed herein include a case with a rotatable housing. The rotatable housing may be cylindrical in shape and include compartments that may be independently and individually accessed. The rotatable housing may be encompassed by a frame. The framed may include an access portion where different compartments may be individually and independently accessed by rotating the housing to align different compartments with the access portion.

Turning now to FIG. 1, an embodiment of a storage case 100 is depicted. Storage case 100 may include housing 101, frame 102 and base 107.

Housing 101 may be a cylindrical or disk-shaped housing 101 configured to be rotated around axle 104. If housing 101 is rotated, lock receiving members 117 may receive a lock to secure housing 101 in place within frame 102. Housing 101 may include a plurality of compartments 121 configured to store and/or transport items, which may be weapons such as a handgun or a pistol.

Compartments 121 may be uniformed or non-uniformed in shape, and each may make up a section of housing 101. In one embodiment, compartments 121 may be substantially triangular in shape. Disposed within compartments 121 may be foam or any other padded material 112 configured to protect items disposed within compartments 121.

Each compartment 121 may include a corresponding door 105. Door 105 may be coupled to housing 101 via a hinge disposed on the curved surface of housing 101. Therefore, each compartment 121 may be individually accessed via a respective door 105. Door 105 may be opened and closed so items may be placed in or withdrawn from compartment 121. In an example embodiment, door 105 may be secured via a latch 106 on door 105, which may include a spring. The latch 106 on door 105 may be configured to keep door 105 closed when rotating housing 101 to secure items within compartment 121. Door 105 may be convex in shape to allow room from an item housed in compartment 121 to protrude from compartment 121 if door 105 is opened. In one embodiment, if the item is a weapon, a user may readily grip a handle of the weapon which may be protruding from compartment 121 and from foam 112 while door 105 is open.

Positioned along a curved surface of housing 101 may be frame 102. Frame 102 may be comprised of any rigid material such as plastic, metal, etc. Frame 102 may include handle 103 to assist in transporting storage case 100. A substantial portion of frame 102 may be positioned along the center of the curved surface of housing 101.

Frame 102 may include an access portion 122. Access portion 122 may be a section along frame 102 that is configured to allow door 105 corresponding to compartment 121 to be opened and closed. In one embodiment, frame 102 may only include one access portion 122 such that only one door 105 may be opened at any given time. Therefore, frame 102 may keep doors not aligned with access portion 122 from opening. Accordingly, frame 102 may allow each door 105, sequentially, to be in an unlocked state while aligned with access portion 122. In an embodiment, doors that are not aligned with access portion 122 may be locked without having to individually lock or unlock each door 105. Therefore, frame 102 may obstruct, block or not allow access to doors 105 not aligned with access portion 122. In an example embodiment, access portion 122 may project parallel to an edge of housing 101 and extend along a face 120 of housing 101 for a length sufficient to allow a door 105 to be opened and/or closed. In one embodiment, access portion 122 may be positioned on an upper portion of housing 101 such that a compartment 121 aligned with access portion 122 may be angled upward so a user may access an item disposed within compartment 121 in a more upright and safer position.

To secure housing 101 in a position such that no compartments 121 are aligned with access portion 122, frame 102 may include locking member 115. Locking member 115 may be configured to couple with lock receiving members 117 to secure housing 101 in place and not allow housing 101 to rotate. Locking member 115 may be configured to extend through frame 102 and into receiving member 117. The portion of the frame where locking member 115 is positioned may include locking mount 116 (as illustrated in FIG. 1C).

Frame 102 may also include an elongated portion 123 that extends from a portion of frame 102 on the curved surface of housing 101 to the center of housing 101 adjacent to a face 120 of housing 101. Coupled to elongated portion 123 may be axle 104 configured to traverse a center of housing 101, and provide a point of rotation for housing 101. Housing 101 may be rotated in direction 114 around axle 104 so that different compartments 121 may be independently or individually aligned with access portion 122. By rotating housing 101, each compartment 121 may be sequentially rotated to align with access portion 122 where a different compartment 121 may be accessed.

To support housing 101 and frame 102, a base 107 may be coupled to housing 101 and frame 102. Base 107 may include an orifice that is shaped to receive frame 102 and housing 101. Base 107 may extend past a width and a length of frame 102 to provide additional stability.

Base 107 may include additional compartments to store items. In one embodiment, base 107 may include a drawer 110 configured to store objects and slide in and out of base 107. A top surface of base 107 may include lid 108 and magnet 111. Lid 108 may be raised to provide access to additional storage for items within base 107. Lid 108 may include a lock 109 to further secure items disposed within base 107. If lid 108 is raised, magnet 111, attached to lid 108, may couple with the metal in elongated portion of frame 123 to assist lid 108 to remain in the open position.

Figure 1B:
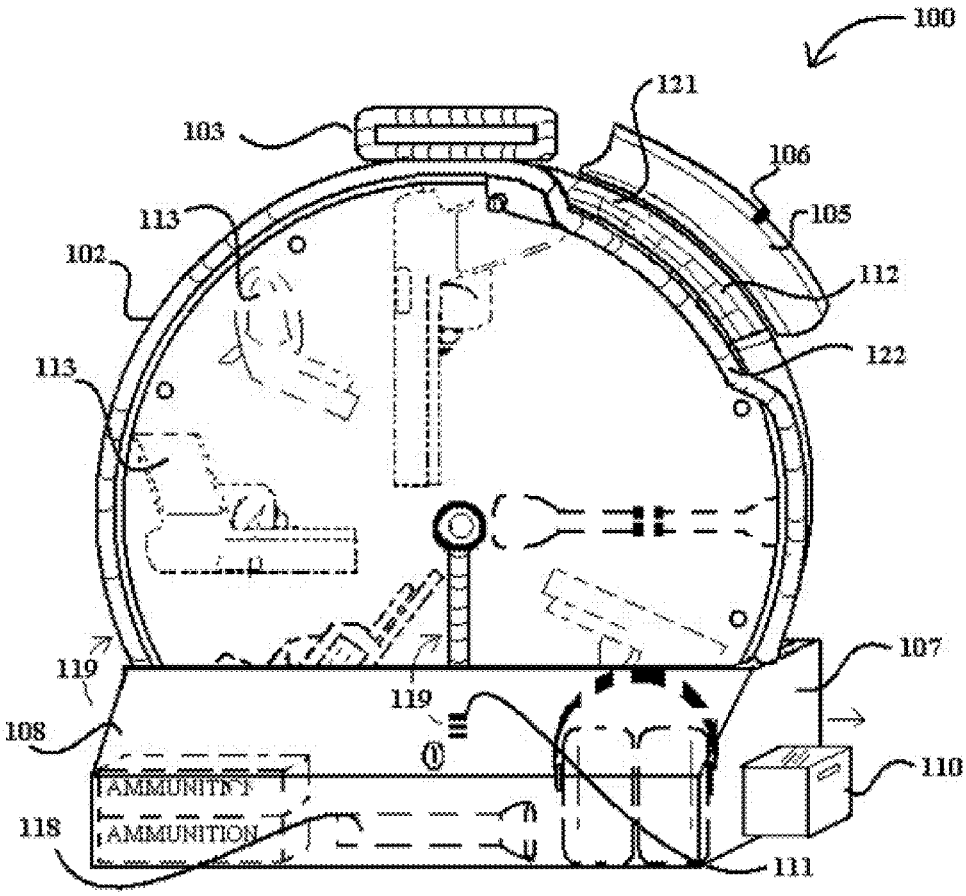
FIG. 1B depicts an embodiment of a case.
Figure 1C:
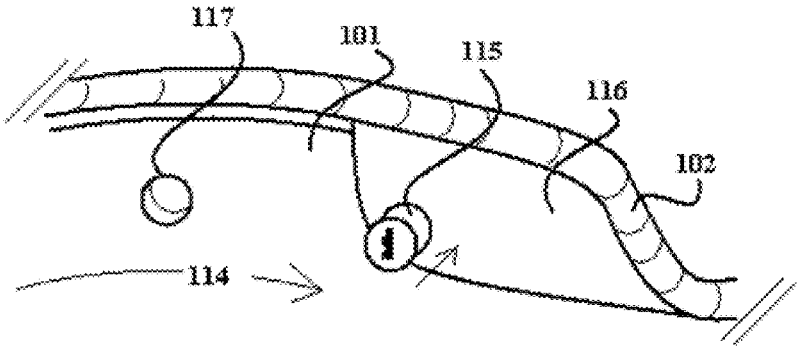
FIG. 1C depicts a detailed view of an embodiment of a locking member and a lock receiving member.

FIG. 1B depicts an embodiment of case 100. As depicted in FIG. 1B, items such as pistols 113 may be positioned in different compartments 121. Pistols 113 may be disposed within compartments 121 such that a muzzle of the pistol 113 is positioned in close proximity to axle 104 and the handle or grip of pistol 113 is positioned in close proximity to the curved surface of housing 101. In one embodiment, this may result in a more efficient use of storage space.

As depicted in FIG. 1B, base 107 may be configured to store various items, tools and supplies 118 such as ammunition, a flashlight, hearing protection, etc. Supplies 118 may be placed within base 107 by opening lid 108 in direction 119, placing the supplies 118 in base 107 and closing lid 108. Furthermore, as shown in FIG. 1B, drawer 110 may be extended and project away from base 107 to store items within drawer 110.

FIG. 1C depicts an embodiment of a detailed view of locking member 115 and lock receiving member 117. Locking member 115 may be positioned on lock mount 116, which may be positioned on an inner portion of frame 102 and covering a portion of a face of housing 101. As housing 101 is rotated, where in one embodiment may be rotated in direction 114, lock receiving member 117 may be aligned with locking member 115. Locking member 115 may then be pressed inward, engage with lock receiving member 117, and secure housing 101. Locking member 115 may then be ejected or removed from lock receiving member 117, and housing 101 may be rotated in direction 114 to access one of the compartments 121. When locking member 115 and lock receiving member 117 are aligned, none of the access doors 105 may be aligned with access portion 122. This may allow case 100 to be locked from access to any compartments 121.

Figure 2A:
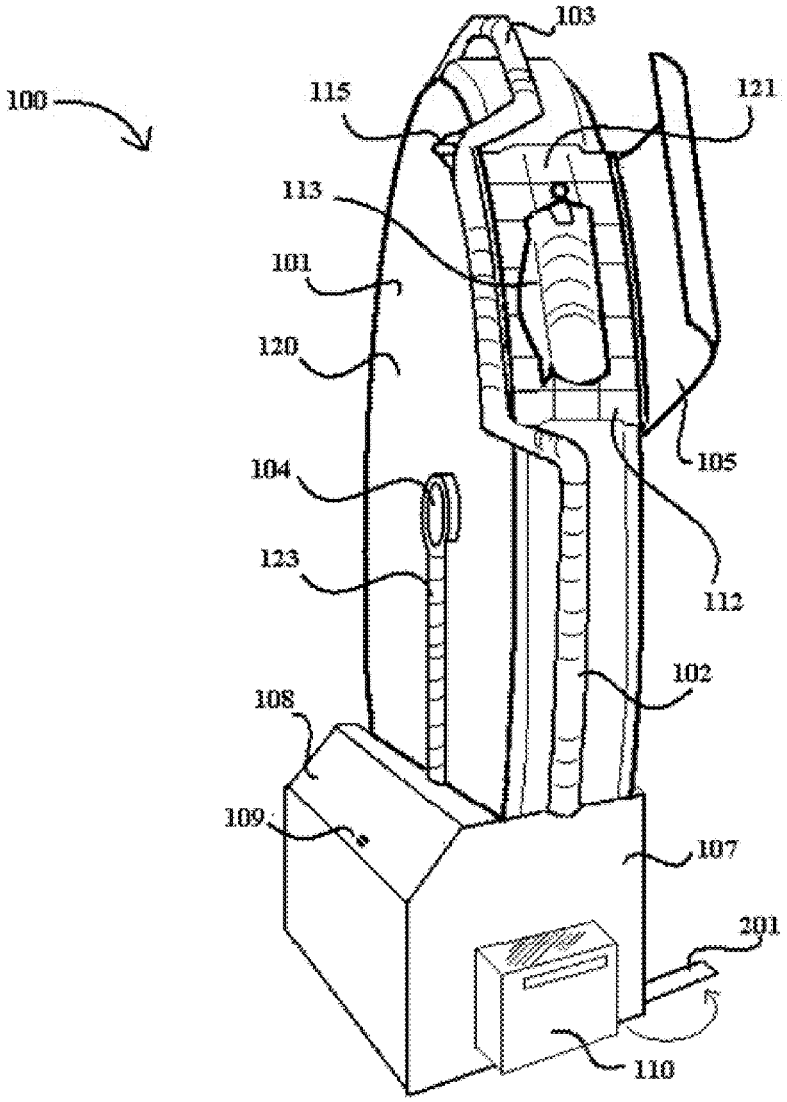
FIG. 2A depicts an embodiment of a perspective view of a case.

FIG. 2A depicts an embodiment of a perspective view of case 100. As depicted in FIG. 2A, frame 102 extends across at least a portion of the curved surface of housing 101. Across access portion 122, frame 102 may jut towards face 120 of housing 101. As such, frame 102 is configured to enclose doors 105 except for in access portion 122, where door 105 may be opened. In other words, frame 102 may be configured to keep doors 105 closed when they are not positioned adjacent to access portion 122.

Door 105 may have a curved, concave surface that projects outward along the curved surface of housing 101. In an example embodiment, if an item such as weapon 113 is disposed within compartment 121 with an open door, weapon 113 may not be fully covered, concealed, or encompassed by housing 101. As such a handle of weapon 113 may project outward from compartment 121.

As depicted in FIG. 2A, coupled to base 107 may be extendable legs 201. Extendable legs 201 may extend outward from a lower portion of base 107 to stabilize case 100. Legs 201 may project perpendicular to housing 101 and away from base 107 when extended. Legs 201 may contract and be positioned within base 107 when not in use. In an example embodiment, legs 201 may be configured to fold into base 107 when not in use, and fold outward to stabilize case 100.

Figure 2B:
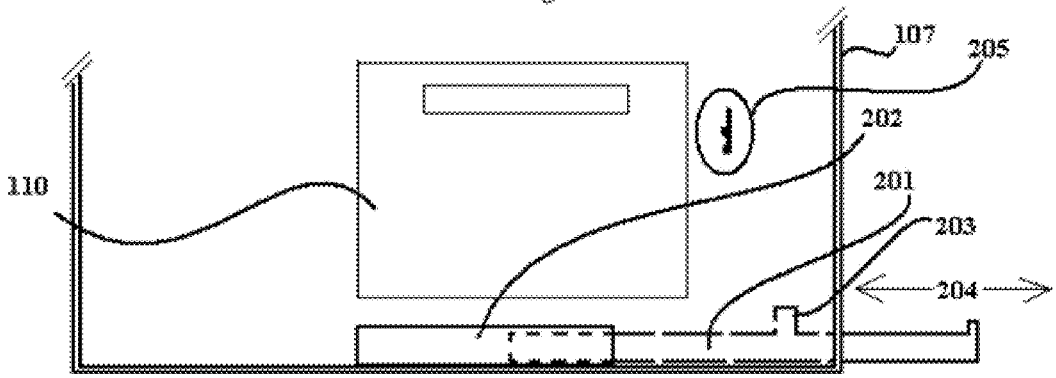
FIG. 2B depicts an embodiment of a detailed view of a base storage compartment.

FIG. 2B depicts an embodiment of a detailed view of base 107. As depicted in FIG. 2B legs 201 may be configured to be disposed in orifice 202, and legs 201 may extend outward from orifice 202 and outward from base 107 while a portion of leg 201 remains within orifice 202. Legs 201 may extend and/or contract from base 107 in a direction 204 parallel to the surface of a floor.

In an example embodiment, legs 201 may include leg stop 203. Leg stop 203 may be positioned on a surface of leg 201 within base 107. If leg 201 is disposed within orifice 202, leg stop 203 may be positioned adjacent to orifice 202. If leg 201 is extended outward from base storage compartment 107, leg stop 203 may reposition adjacent to an inner sidewall of base 107 to impede, block, or obstruct the movement of leg 201.

FIG. 2B also depicts an example embodiment of base 107 including drawer 110 with a corresponding lock 205. Lock 205 (and other locks disclosed herein) may be any type of lock or fastening device that is released by a physical object such as a key, keycard, fingerprint, RFID card, or security token or secret information such as a key code or password, or combination of one or more of these.

FIG. 3A depicts a perspective view of an example embodiment of housing 101. The center housing 306 of housing 101 may be configured to receive axle 104 or axle assembly. Axle assembly may be configured to rotate housing 101 around an axis. Axle assembly may be configured to constrain the relative motion of housing 101 to a desired motion. Further, axle assembly may prevent or limit unwanted rotational movement of housing 101. In one embodiment, a user may apply pressure to a surface of housing 101, and axle assembly may allow housing 101 to be rotated and then stopped in a desired position.

In one embodiment, the opposing faces of housing 101 may be coupled together via spacing bars 303, and spacing bars 303 may be positioned at the edge of housing 101. Spacing bars 303 may be flat or convex and couple the opposing faces of housing 101 together via screws and connection holes 312(*a*) (*b*) or any known coupling means. In one embodiment, the length of the spacing bars 303 may define the width of housing 101. Spacing bars 303 may be configured to project outward from housing 101 and be convex in shape. In an embodiment, spacing bars 303 may also be configured to couple and/or interface with an inner surface of door 105. As such, the convex shape of spacing bars 303 may be coupled with the concave shape of door 105. Door 105 may include a door latch release 311 to open and close. In one embodiment, door latch release 311 may include a spring release 106.

To secure an item within compartment 121, compartment 121 may house a tray 301. Tray 301 may be sized to fit a section of housing 101, and may be substantially triangular in shape. A first side 313 of tray 301 may couple with an outer portion of center housing 306 disposed within an inner surface of housing 101. A second side 314 of tray 301 may be positioned adjacent to door 105 on the curved surface of housing 101. As such tray 301 may extend from the center housing 306 to the curved surface of housing 101. Tray 301 may have a width that is slightly less than that of housing 101, such that tray 301 may be securely housed within compartment 121. In an embodiment, tray 301 may be fixed within housing 101, while in another embodiment tray 301 may be a removable tray. One skilled in the art will appreciate that tray 301 and/or compartment 121 may be any desired size and shape, and different trays and/or compartments may have varying sizes and shapes which may be in an offset formation. As such, different sized trays/compartments may be used to house different sized items.

Tray 301 is configured to be filled with foam 112. Foam 112 may be cut into smaller shapes, cubes, and/or layers. In one embodiment, foam 112 may have a plurality of layers shaped to secure an item within tray. As such, layers of foam 112 may include grooves, trenches, etc. to conform to the shape of any item. In one embodiment, foam 112 may be foam cubes that are individually removable, and may be configured to secure an item within tray 301. Therefore, foam 112 may be used to dynamically customize tray 301 to any desired shape.

Tray 301 may include a lip 302. Lip 302 may be positioned at second side 314 of tray 301 and be configured to hold foam cubes 112 in place during extraction of an item from tray 301. Lip 302 may hold foam 112 within tray 301, whether tray 301 is removed from compartment 121 or disposed within compartment 121.

Tray 301 may be secured in place inside compartment 121 via a hinged tray retention bar 304. Retention bar 304 is configured to be disposed on an outward facing surface of spacing bar 303, and adjacent to door 105 when door 105 is in a closed positioned. Retention bar 304 may be substantially the same shape as spacing bar 303, and be secured adjacent to spacing bar 303 by screws or any other coupling means. In one embodiment, to remove tray 301 from compartment 121, door 105 corresponding to compartment 121 may be opened, hinged retention bar 304 may be removed or folded away, and tray 301 may be removed. While tray 301 is removed, foam 112 may be rearranged as desired or required. Tray 301 may then be inserted into compartment 121, and secured by folding or replacing retention bar 304 back in place.

FIG. 3B(1) depicts an embodiment of a front view of retention bar 304 in relation to spacing bar 303. FIG. 3B(2) depicts an embodiment of a side view of retention bar 304 in relation to spacing bar 303. As depicted in FIGS. 3B(1) and (2) retention bar 304 is configured to be placed adjacent to spacing bar 303 if a door (not shown) corresponding to a compartment (not shown) is closed. If the door 105 is opened, retention bar 304 may be configured to be unsecured then to rotate away from spacing bar 303 via hinge 315.

Figure 3C:
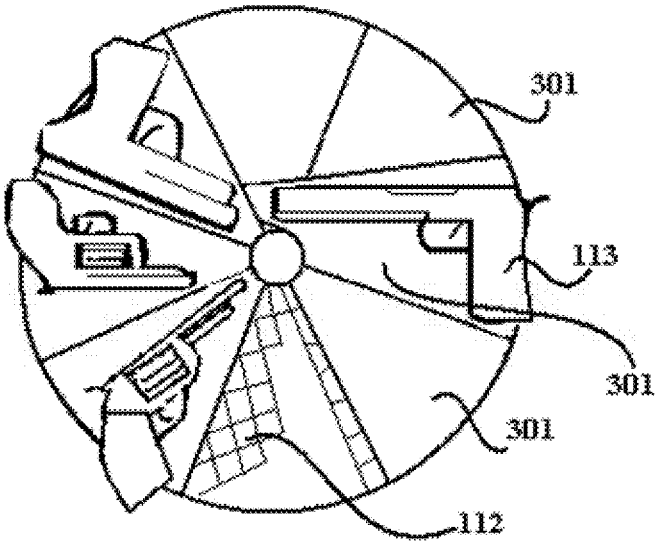
FIG. 3C depicts an embodiment of compartments within a housing.

FIG. 3C depicts an embodiment of an inner surface of housing 101. As depicted in FIG. 3C, a plurality of trays 301 may be disposed within housing 101 due to the cylindrical shape of housing 101. Although trays 301 are substantially triangular in shape, each tray 301 may be a different shape and may be configured to house items of different shapes and/or sizes. The different sized items may be secured within different sized trays 301 by dynamically placing foam 112 within tray 301.

Figure 3D:
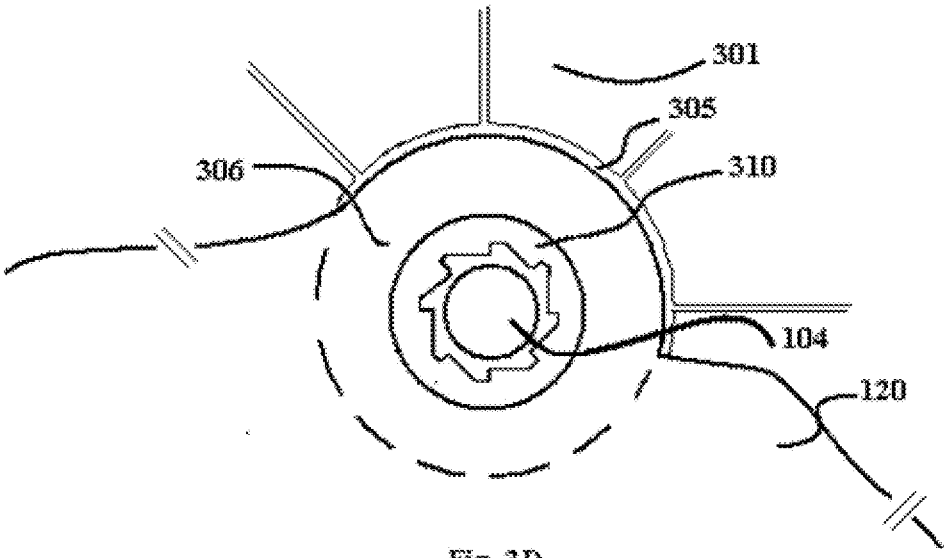
FIG. 3D depicts an embodiment of a detailed view of a center of a housing and axle assembly.

FIG. 3D depicts an embodiment of a detailed view of center housing 306 and adjacent axle assembly 310. Axle assembly 310 may include axle 104, gears, bearings, teeth, washers, connectors, and or any other devices to control the movement of housing 101. Center housing 306 may have a padded outer surface 305, (which is disposed within compartment 121). In one embodiment, each of the surfaces within compartments 121 may also be padded. As depicted in FIG. 3D, axle assembly 310 will control the rotation of housing 101. As housing 101 is rotated, axle assembly 310 may correspondingly restrict the rotation of housing 101. As such, sufficient pressure may be required to a surface of housing 101 to rotate housing 101 around axle 104. Therefore, housing 101 may not be undesirably or unintentionally rotated by the shifting contents of the case.

Figure 4:
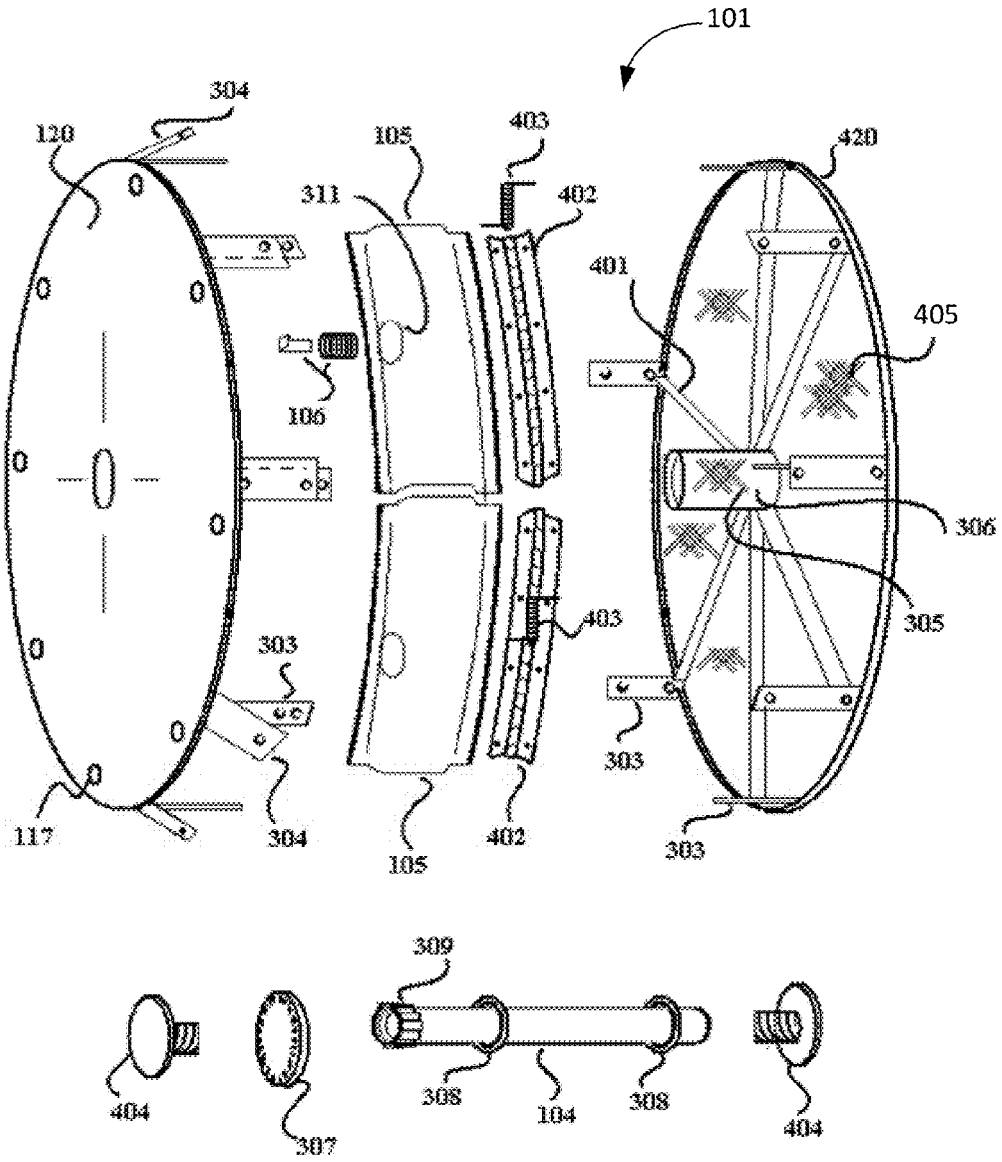
FIG. 4 depicts an embodiment of an exploded view of a housing.

FIG. 4 depicts an example embodiment of an exploded view of housing 101. As depicted in FIG. 4, housing 101 includes face 120 with retention bars 304, which may be hinged, and spacing bars 303. On a surface of face 120 may be a plurality of lock receivers 117 that are configured to receive a locking mechanism coupled to a frame (not shown). Furthermore, doors 105 may be configured to be coupled to a circumference of face 120.

Housing 101 may include a second face 420 with a padded inner surface 405. Face 420 may include a plurality of spacing bars 303 and center housing 306. In one embodiment, an inner surface of face 420 may be covered by a foam lining 405 and the outer surface of center housing 306 on an inner surface of housing 101 may be covered by a foam lining 305. On an inner surface of face 420 may be a plurality of compartment dividers 401. Dividers 401 may be positioned to define the shape and/or size compartments within housing 101. One skilled in the art will appreciate that the compartments within housing 101 may be uniformly or non-uniformly sized.

Hinge 402 may be curved and configured to be rotated across the edge of housing 101. Hinge 402 may be coupled to door 105 via any known coupling means, such as screws. Additionally, hinge 402 may include spring 403 that may be used to apply force to assist in the opening rotation of hinge 402 and door 105.

When door 105 is in an opened position, a compartment defined by compartment dividers 401 may be accessed. When door 105 is in a closed position, a first edge of door 105 may be adjacent to a portion of the circumference of face 420 and a second edge of door 105 may be adjacent to a portion of the circumference of face 120.

Center housing 306 may be padded 305 and couple with axle 104 such that housing 101 may be rotated around axle 104. In one embodiment, center housing 306 may be hollow and extend from face 120 to face 420. Axle 104 may traverse center housing 306. Axle 104 may include an axle assembly to rotate housing 101. In one embodiment, to secure axle 104 within housing 101, axle caps 404 may be position on an each side of axle 104 on an outer surface of faces 120 and 420.

Figure 5:
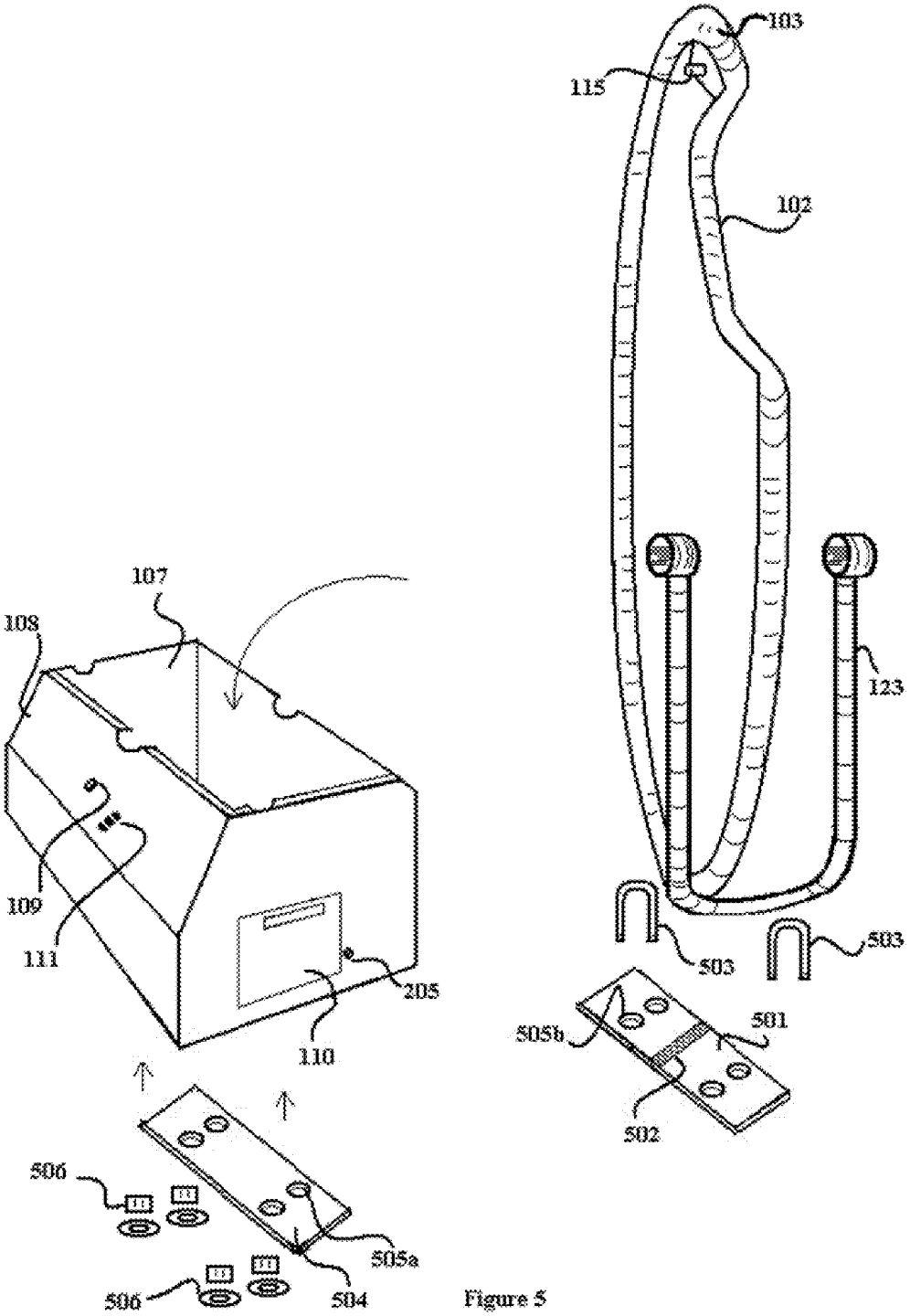
FIG. 5 depicts an embodiment of an exploded view of a base storage compartment and a frame.

FIG. 5 depicts an embodiment of an exploded view of base 107 and frame 102. In one embodiment, on a lower surface of base (not shown) may be a plurality of orifices corresponding to holes 505(*a*) on lower connecting plate 504 and holes 505(*b*) on upper connecting plate 501. Lower connecting plate 504 may be configured to be aligned with the orifices within base 107 on an outer surface of base 107, and upper connecting plate 504 may be configured to be aligned with the orifices within base 107 on an inner surface of base 107. Frame 102 may then be positioned over upper connecting plate 501. Connecting brackets 503 may then be placed over frame 102 and through holes 505 (*a*) and (*b*). Connectors 506 may then be coupled with connecting brackets 503 to secure frame within base 107.

In one embodiment, upon coupling connectors 506 with connecting brackets 503, frame 102 may be welded to upper connecting plate 501. In one embodiment, upper connecting plate 501 may include a weld point marker 502 identifying a location along upper connecting plate 501 where frame 102 could be welded to upper connecting plate 507.

Figure 6:
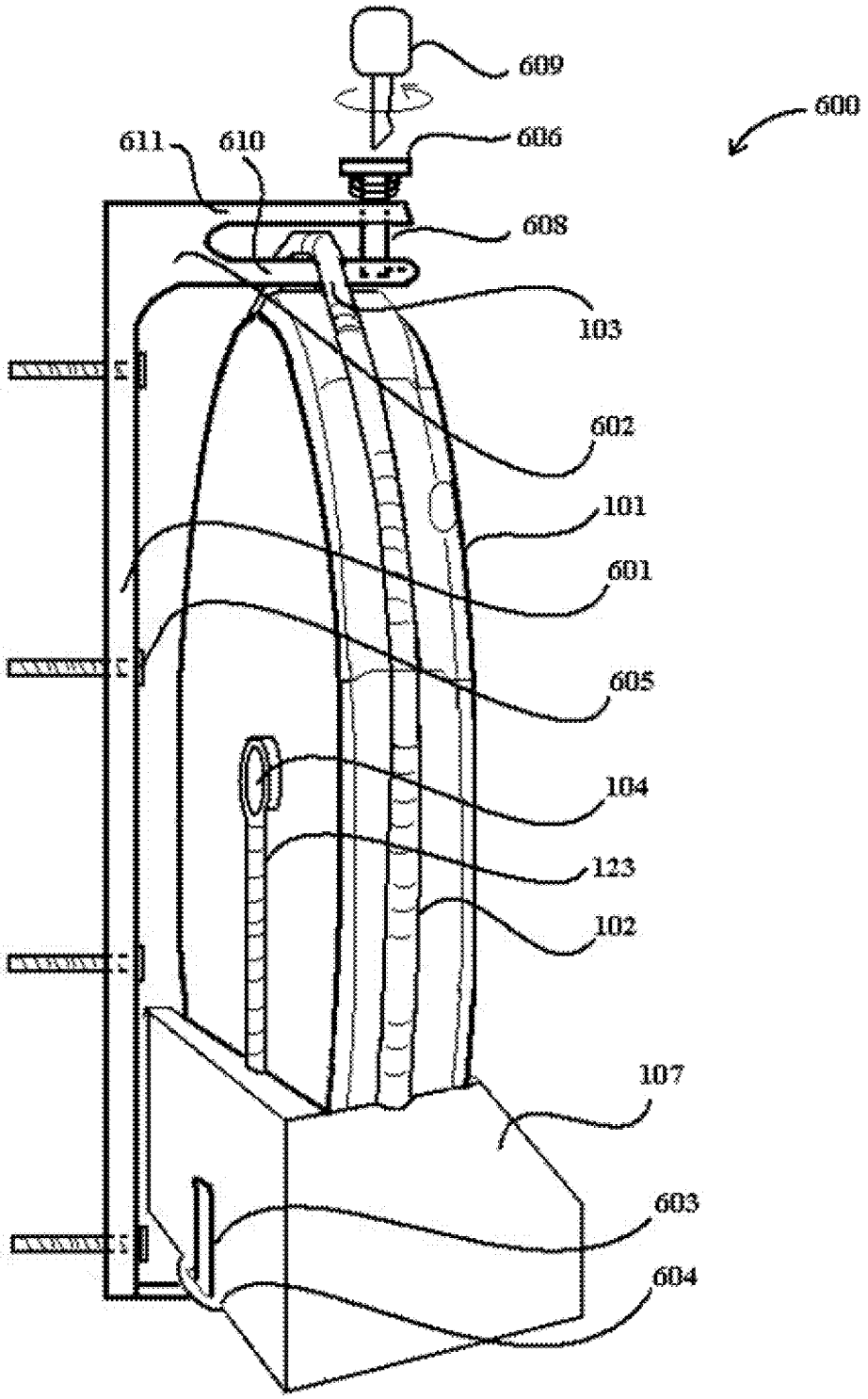
FIG. 6 depicts an embodiment of a docking station to secure a case to a physical structure.

FIG. 6 depicts an embodiment of a docking station 600 to secure case 100 at a physical device or structure, such as a wall, door, desk, vehicle, etc.

Docking station 600 may include a dock riser 601 that extends from the bottom of base 107 to handle 103 of housing 101. Dock riser 601 may be comprised of any rigid material, such as metal, plastic, etc. Dock riser 601 may be secured to a physical structure via bolts and/or screws or any known connectors 605.

A dock hook 603 may be positioned at a lower end of dock riser 601. Dock hook 603 may extend perpendicularly from dock riser 601, and then upward in a parallel or substantially parallel direction with respect to dock riser 601. As depicted in FIG. 6, base 107 may include a hook receiver 604. Hook receiver 604 may be a projection from a surface of base 107 with an orifice, which in one embodiment may be a lower surface of base 107. However, one skilled in the art will appreciate that hook receiver 604 may be positioned at other positions on any surface of base 107. Dock hook 603 may couple with hook receiver 604 to secure base 107 to dock riser 601. One skilled in the art will appreciate that any known coupling mechanisms may be used to couple base 107 to dock riser 601. Hook receiver 604 may be a projection from, or a depression in, a surface of case 100 with an orifice, which in one embodiment may be a lower surface of case 100. This would allow base 107 to mount flush adjacent to dock riser 601.

At an upper surface of dock riser 601 may be positioned a dock arm 602. Dock arm 602 may receive handle 103 of frame 102, extend perpendicularly to dock riser 601, and past handle 103. Dock arm 602 may have multiple prongs 610 and 611. Handle 103 may be positioned adjacent to prong 610 and between prongs 610 and 611 to secure frame 102 and housing 101 to docking station 600. Prongs 610 and 611 may have holes where a lock bolt 608 of lock 606 may be extended through the holes to lock frame 102 and housing 101 to docking station 600. In one embodiment, to unlock lock 606 a key 609 may be used. However, lock 606 may be any type of known locking device, which may or may not require a key.

Figure 7:
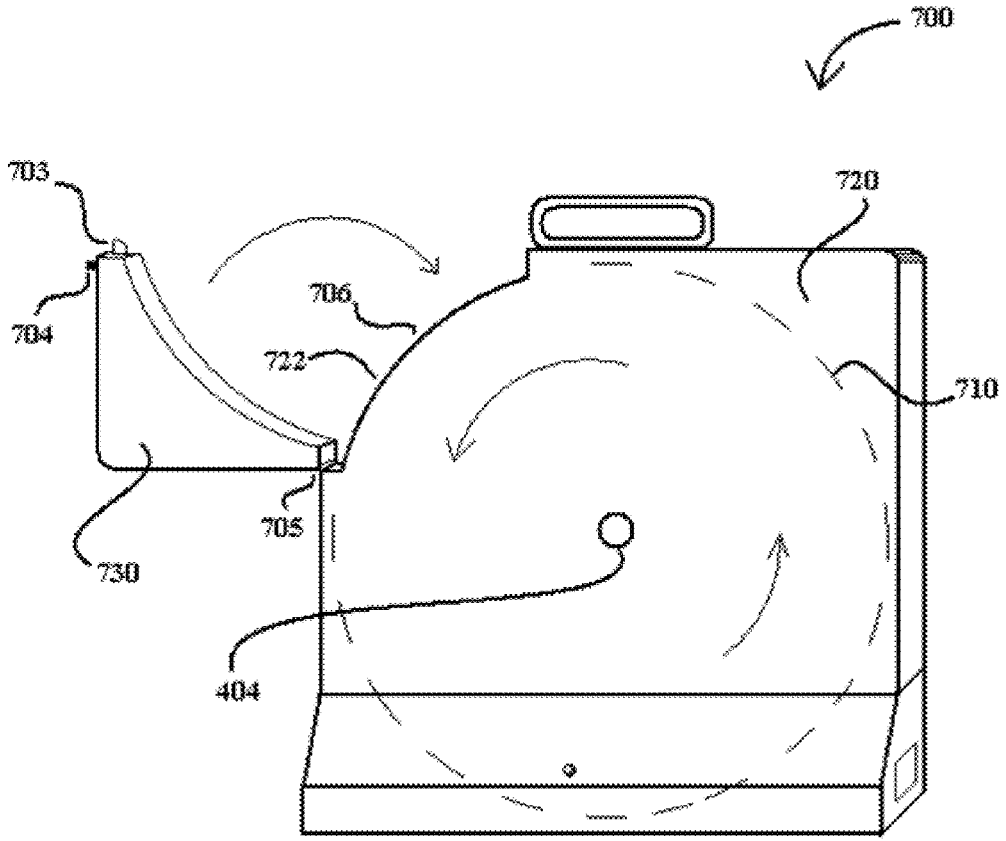
FIG. 7 depicts an embodiment of case.

FIG. 7 depicts an embodiment of case 700. Elements in FIG. 7 may be substantially similar to those disclosed within this disclosure; and for the sake of brevity an additional disclosure of these elements is omitted.

Case 700 may include cylindrical housing 710 and shell and frame 720. Housing 710 may be disposed within a cylindrical orifice within shell and frame 720. Shell and frame 720 may be a unitary element, and may be a shell for housing 710 and a support frame. In one embodiment, a corner portion of shell and frame 720 may be a door 730 coupled to shell and frame 720 via latch 703 and hinge 705. Latch 703 may be released by pressing a button 704.

Door 730 may be rotated away from shell and frame 720 via hinge 705 to reveal compartments 706 within housing 710. Therefore, when door 730 is in an open positioned, items positioned in a compartment 706 aligned with door 730 may be accessed, which in one embodiment may be only one compartment 706. In one embodiment, compartments 706 within housing 710 may not have individual doors, and items within each compartment may be accessed via door 730. In one embodiment, the compartments within housing 710 may each have an individual door, which may be opened and/closed to access items disposed within a corresponding compartment. Door 730 may also incorporate a lock to prevent door 730 from opening, thereby locking case 700 and securing the contents within.

When disposed within shell and frame 720, housing 710 may be configured to rotate. In one embodiment, housing 710 may only be able to rotate in a single direction while disposed within shell and frame 720.

Figure 8A:
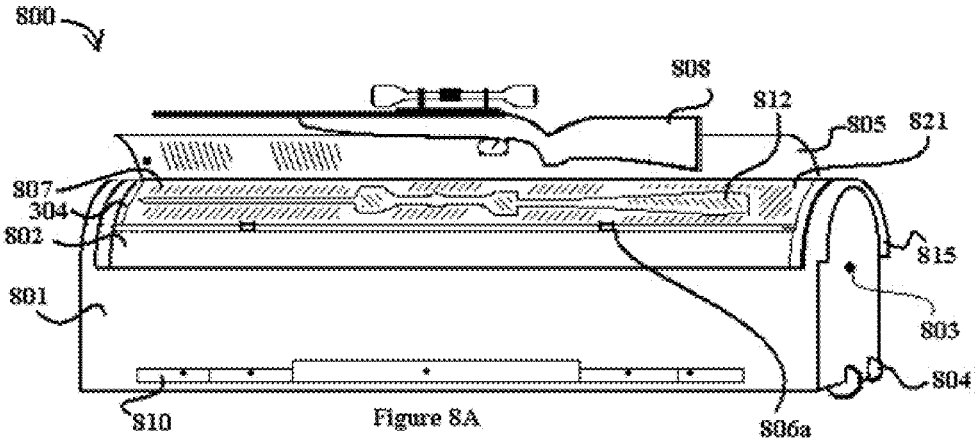
FIG. 8A depicts an embodiment of a case.

FIG. 8A depicts an embodiment of case 800. As depicted in FIG. 8A, base 802 may be a combination of a storage compartment and frame that extends across at least a portion of the curved surface of housing 801. Across access portion 822 (as depicted in FIG. 8C), base 802 may widen. As such, base 802 may be configured to enclose doors 805 except for in access portion 822, where door 805 may be opened. In other words, base 802 may be configured to keep doors 805 closed when they are not positioned adjacent to access portion 822.

Case 800 may include housing 802 comprised of any rigid material such as plastic, metal or aluminum, configured to house various items such as rifles or any other longer items. Housing 802 may include a plurality of compartments 821. Case 800 may include a base 801, comprised of any rigid material. Base 801 may also serve as frame for housing 802. Housing 802 may rotate around a support axle 813 extending through base 801 and housing 802 adjacent to center housing 817, configured to receive axle 813. In an embodiment, axle 813 may be anchored to base 801 through axle support hole 803. In one embodiment, housing 802 may rotate around the axle 813 in a single direction. In another embodiment, housing 802 may rotate around the axle 813 in either direction. In an example embodiment, housing 802 may be configured to receive axle 813 to rotate housing 802.

The compartments 821 may be configured to receive a foam inlay and/or tray 807. Tray 807 may be a removable tray configured to house a number of inlays 812 on the outward-facing edge. The inlays 812 may be removable to allow tray 807 to be custom fitted to receive an item 808, such as a rifle. As such, each compartment 821 may be custom fitted to an item 808. Door 805 may have a layer of padding to add protection to the contents of compartment 821.

Each compartment 821 may include a door 805. Door 805 may be configured to extend from a lower face of housing 802 to an upper face of housing 802. In one embodiment, door 805 may be coupled to housing 802 via a hinge (not shown) that extends from the lower face of housing 802 to the upper face of housing 802. However, in other embodiments, door 805 may be coupled to housing 802 via a hinge that is positioned only on the upper face or lower face of housing 802. In one embodiment, door 805 may be coupled to housing 802 or to base 801. Door 805 may be positioned along a curved surface of housing 802 and correspond to compartment 821. Door 805 may be convex in shape with respect to housing 802. To couple door 805 to housing 802, a latch 806*a* may be positioned on housing 802. Latch 806*a* may receive latch 806*b* and secure door 805 to housing 802. Latch 806*a/b* may also receive force to uncouple door 805 from housing 802 to expose compartment 821.

In one embodiment, housing 802 may be configured to be rotated while case 800 is in an upright position, and item 808, positioned within compartment 821, within housing 802, may be retrieved or stored by opening and closing door 805, corresponding to compartment 821. To stabilize case 800 in an upright position, a lower face of case 800 may include a lip 815 or other stabilizing mechanism such as extendable and/or contractible legs. In one embodiment, case 800 may include a plurality of wheels 804 positioned at a lower surface of case 800.

In an example embodiment, along a body of base 801 may be a plurality of compartments 810. Compartments 810 may be drawers that may be used to house items, supplies and/or ammunition.

Figure 8B:
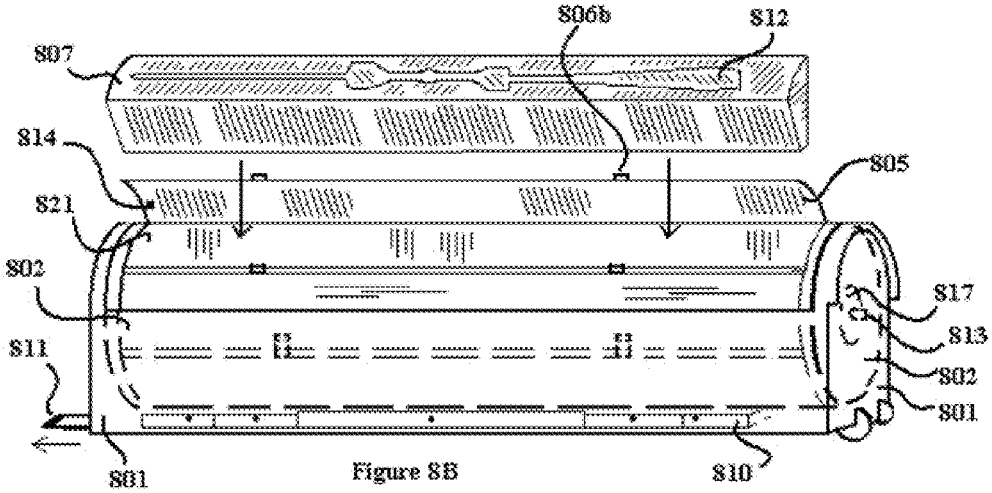
FIG. 8B depicts an embodiment of a case.
Figure 8C:
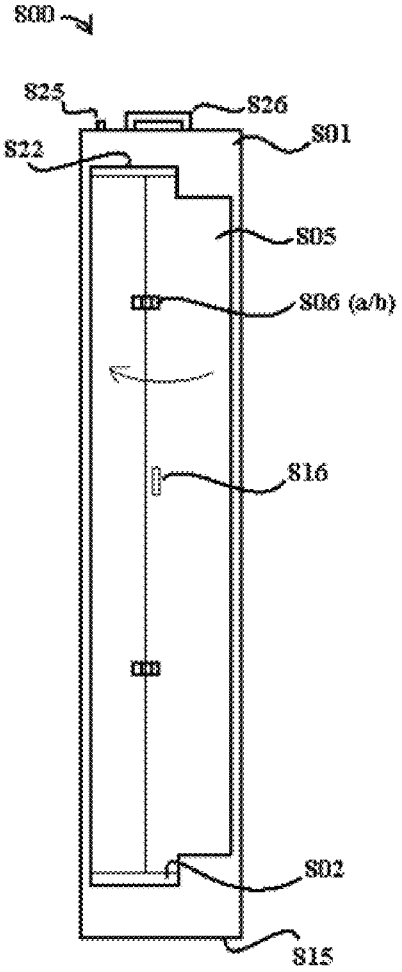
FIG. 8C depicts an embodiment of front view of a case.

FIG. 8B depicts one embodiment of case 800. In one embodiment, case 801 may be used to transport housing 802. Base 801 may extend from a lower face of housing 802 to an upper face of housing 802. At an upper surface of base 801 may be an extendable and contractible handle 811.

As depicted in FIG. 8B, a compartment 821 within housing 802 may include tray 807 configured to house inlays 812, which may be comprised of any type of padding, cushioning, and/or foam. Tray 807 may be a removable insert, which may be removed from housing 802 so a user may more safely handle an item (not shown).

In one embodiment, a magnet 814 may be imbedded in door 805, and a corresponding coupling magnet may be imbedded in base 801. If door 805 is in an open position, door 805 may be positioned adjacent to base 801, and the coupling magnet 814 in base 801 may attract the magnet disposed within door 805 to keep door 805 open. Therefore, items placed within compartments 821 of housing 802 may not be damaged by door 805 accidently closing shut.

FIG. 8C depicts an embodiment of front view of case 800 and housing 802. Housing 802 may be configured to rotate within base 801 if case 800 is placed upright or on its side. A door 805 may include a latch 806(*a*) configured to couple a latch receiving mechanism 806(*b*) to securely couple door 805 in a closed position. Latch 806(*a*) and latch receiving mechanism 806(*b*) may be uncoupled, and door 805 may be opened if alighted with access portion 822.

Access portion 822 may be a section within base 801 where door 805 may be opened and closed. In one embodiment access portion 822 may be configured to be at least a width of door 805, such that door 805 may open and closed if aligned with access portion 822. More specifically, in an embodiment, access portion 822 may be an orifice within base 801 configured to align with door 805, such that housing 802 may be rotated, align door 805 with access portion 822 and door 805 may be opened and closed within access portion 822 while securing other doors of housing 802 to remain closed. In an embodiment, access portion 822 may be configured to allow only a single door 805 of housing 802 to be opened at a single time. Therefore, for another door 805 of housing 802 to be opened, existing door must first be closed, then housing 802 may be rotated, another door 805 of housing 802 may be aligned with access portion 822 and door 805 may be opened. In an embodiment, if door 805 is misaligned with access portion 822 a lock mechanism 825 may be pressed or engaged with to lock housing 802 within base 801, so housing 802 cannot be rotated. Therefore, by locking housing 802 in the locked position each door 805 may be blocked from opening. In a different embodiment, each door 805 may be individually and/or independently locked using any available locking means.

In an embodiment, door 805 may also include a door handle 816. Door handle 816 may be positioned on an outer surface of door 805 to assist in opening and closing door 805. Handle 816 may also be used to assist in the operation and/or controlling the rotation of housing 802.

Figure 8D:
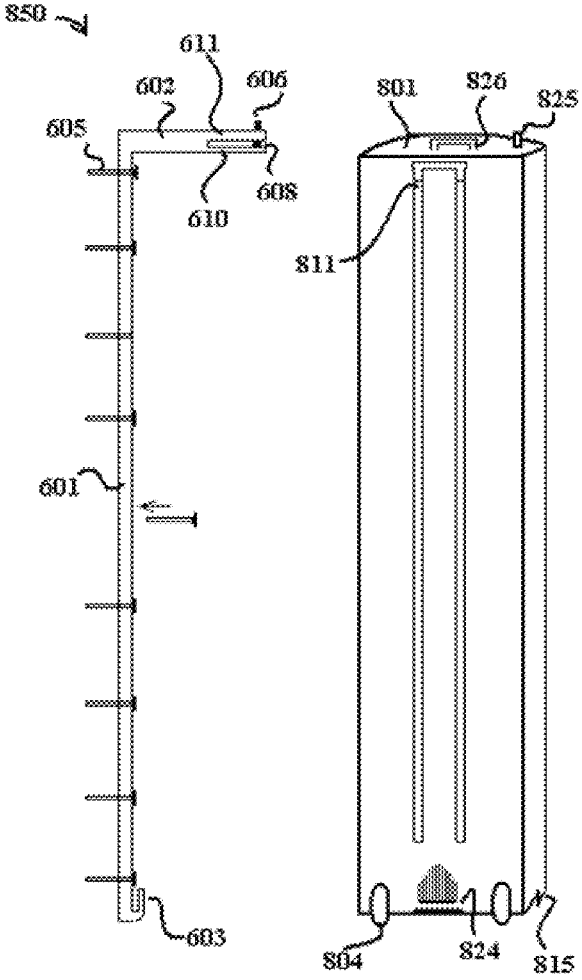
FIG. 8D depicts an embodiment of a docking station to secure a case to a physical structure.

FIG. 8D depicts an embodiment of a docking station 850 to secure case 800 at a physical structure and/or device, such as a wall, door, desk, vehicle, etc. Elements in FIG. 8D may be substantially similar to those disclosed within this disclosure; and for the sake of brevity an additional disclosure of these elements is omitted.

In one embodiment, case 800 may be configured to be secured to a physical structure such as a wall via docking station 850. Docking station 850 may include a dock riser 601. Dock riser 601 may attach to a dock arm 602 that is configured to slide through a slot in case 800, such as a handle 826. Dock arm 602 of docking station 850 may include an orifice where a lock 606 may be inserted and locked to secure case 800 to a physical structure.

Hook receiver 824 may be a projection from, or a depression in, a surface of case 800 with an orifice, which in one embodiment may be a lower surface of case 800. However, one skilled in the art will appreciate that hook receiver 824 may be positioned at any position on a surface of case 800. Dock hook 603 may couple with hook receiver 824 to secure case 800 to docking station 850. One skilled in the art will appreciate that any known coupling mechanisms may be used to couple case 800 to docking station 850. In a further embodiment, case 800 may include wheels 804 to assist in the transportation of the case.

Figure 9A:
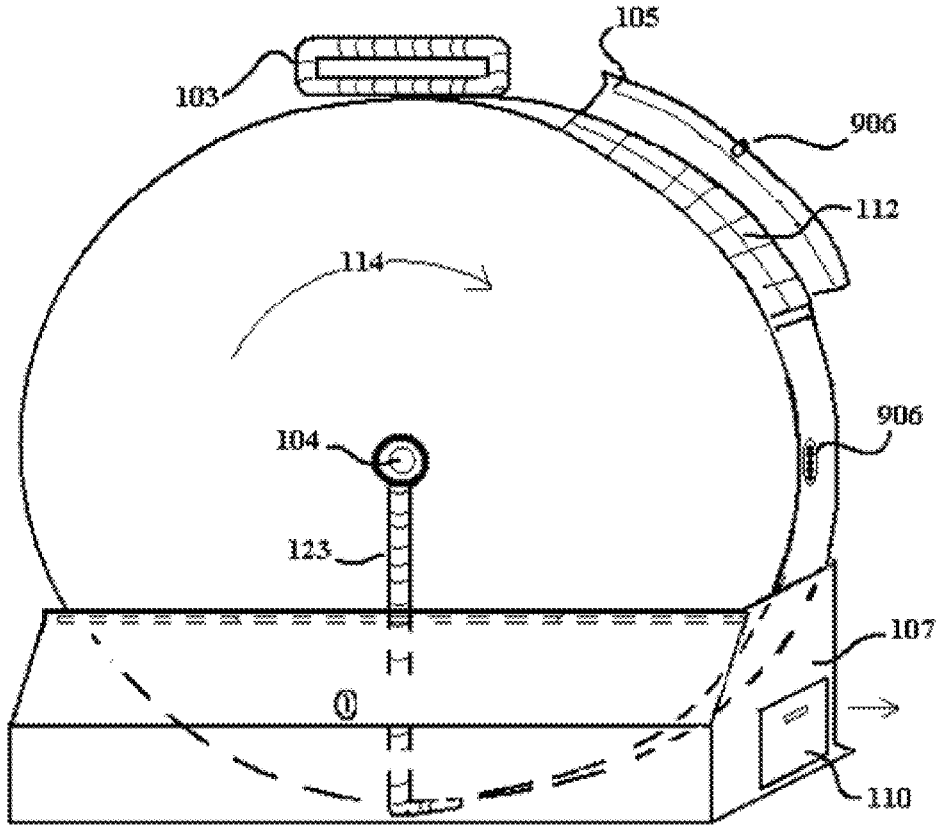
FIG. 9A depicts an embodiment of a front view of a case

FIG. 9A shows a front view of a case with a frame supporting the base and housing by supporting the weight from a cradled position. The frame may have an elongated portion 123 on each side to suspend and support the axle 104 so that the housing may rotate. The individual doors 105 may each be locked individually by lock 906. The lock is of any commercially available design, key, combination, biometric, etc.

Figure 9B:
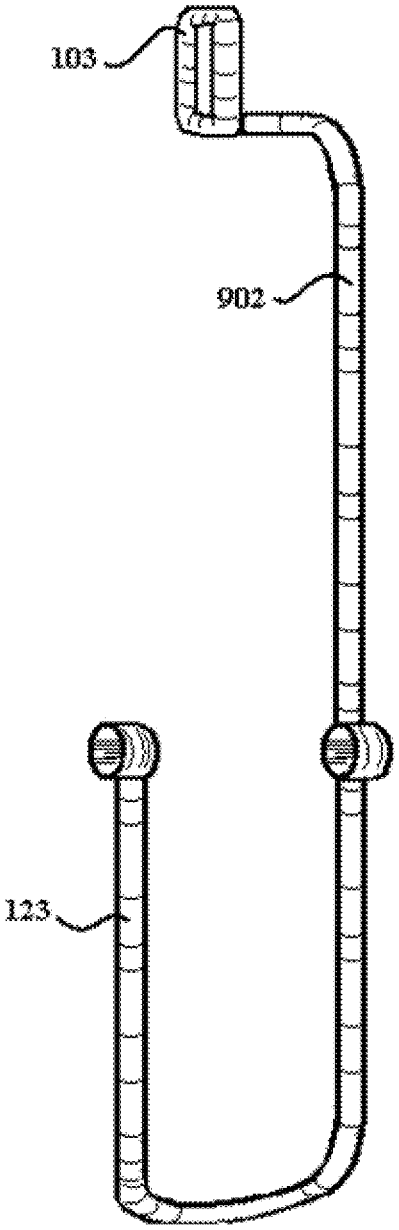
FIG. 9B depicts an embodiment of a frame

FIG. 9B is a perspective view of the frame 902, with a handle 103 being positioned above the housing and the elongated portion 123 of the frame to be on each side of the housing.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function).

Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment," "an embodiment," or "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment.

Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Furthermore, the term "or" as used herein is generally intended to mean "and/or" unless otherwise indicated. As used herein, a term preceded by "a" or "an" (and "the" when antecedent basis is "a" or "an") includes both singular and plural of such term (i.e., that the reference "a" or "an" clearly indicates only the singular or only the plural). Also, as used in the description herein, the meaning of "in" includes "in" and "on" unless the context clearly dictates otherwise.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A case comprising:

a cylindrical housing with a compartment defining a section of the housing, the cylindrical housing being configured to house an item and rotate around an axle disposed at the center of the cylindrical housing;

a frame configured to support the axle, the axle being configured to control the rotation of the cylindrical housing;

an access portion configured to allow access to the compartment, the access portion being part of the frame, wherein the access portion moves the frame from a position on a curved surface of the cylindrical housing towards a first face of the cylindrical housing; and a door coupled to the cylindrical housing configured to open to expose the compartment, wherein a hinge couples the door to the cylindrical housing at an edge between the curved surface of the cylindrical housing and the first face or a second face.

2. The case of claim 1, wherein the door is convex in shape and the access portion extends past a length of the door.

3. The case of claim 1, wherein the door is coupled to the cylindrical housing on an edge of the cylindrical housing.

4. The case of claim 1, wherein the door extends across a curved surface of the cylindrical housing.

5. The case of claim 1, wherein if the door is in an open position part of the item extends past a sidewall of the housing, and if the door is in a closed position the part of the item is covered by the door.

6. The case of claim 1, further including:

a base configured to support the frame and the cylindrical housing, the base including a plurality of partitions configured to house items, wherein the base includes an orifice to receive the frame and the cylindrical housing.

7. The case of claim 1, further comprising:

a plurality of independent compartments; and a plurality of doors, wherein each door corresponds to one of the plurality of independent compartments and includes an independent lock.

8. The case of claim 7, wherein at least two of the plurality of independent compartments are shaped differently.

9. The case of claim 1, wherein the frame is configured to be positioned along a curved surface of the cylindrical housing.

10. The case of claim 1, wherein the frame is configured to extend across a portion of the first face of the cylindrical housing to the axle.

11. The case of claim 1, further including:

a docking station configured to secure the case at a fixed location, wherein an item is still accessible while the case is secured by the docking station, the fixed location being a wall.

12. A case comprising:

a cylindrical housing with a compartment defining a section of the housing, the cylindrical housing being configured to house an item and rotate around an axle disposed at the center of the cylindrical housing;

a frame configured to support the axle, the axle being configured to control the rotation of the cylindrical housing;

a door coupled to the cylindrical housing configured to open to expose the compartment;

a plurality of independent compartments, wherein each of the plurality of compartments includes a respective door;

a locking mechanism positioned on the cylindrical housing configured to restrict the rotation of the cylindrical housing, wherein if the locking mechanism is engaged then the access portion is not aligned with any door to simultaneously lock each of the plurality of compartments.

13. A case comprising:

a cylindrical housing with a compartment defining a section of the housing, the cylindrical housing being configured to house an item and rotate around an axle disposed at the center of the cylindrical housing;

a frame configured to support the axle, the axle being configured to control the rotation of the cylindrical housing;

a door coupled to the cylindrical housing configured to open to expose the compartment;

a tray with a padded inner surface configured to be disposed within the compartment, the tray being a removable tray;

a plurality of independent compartments; and a plurality of foam pieces configured to be arranged within the tray to dynamically create a custom-fit space for the item if the item is disposed within the tray.

14. The case of claim 13, further comprising:

a retention bar positioned between a first face of the cylindrical housing and a second face of the cylindrical housing configured to secure the tray within the cylindrical housing.

15. A gun storage case comprising:

a cylindrical housing being configured to rotate around an axle disposed at the center of the cylindrical housing;

a compartment defining a section of the cylindrical housing configured to house a gun, a door being convex in shape coupled to the compartment configured to open to expose the compartment, wherein if the door is in an open position a handle of the gun extends past a sidewall of the housing, and if the door is in a closed position the handle of the gun is covered by the door;

a tray configured to be inserted and removed from the compartment and to receive the gun, the tray being shaped substantially similar to the compartment;

a lock receiving mechanism disposed on the cylindrical housing;

a plurality of foam pieces configured to custom fit the shape of the tray to the gun;

a frame disposed along a curved surface of the cylindrical housing configured to support the housing; and an access portion configured to project from a position on the curved surface towards an edge of the cylindrical housing, the access portion being at least a length of the door and including a locking mechanism disposed on the cylindrical housing configured to couple with the lock receiving mechanism to misalign the compartment with the access portion and to stop the cylindrical housing from being rotated into a position where the door can be opened.

* * * * *